United States Patent [19]

Chernyak et al.

[11] Patent Number: 4,931,638

[45] Date of Patent: Jun. 5, 1990

[54] METHOD OF MONITORING HIDDEN COAL-ROCK INTERFACE AND TRANSDUCER REALIZING THIS METHOD

[76] Inventors: Zinovy A. Chernyak, Leninsky prospekt, 36, kv. 152, Moscow; Alexandr A. Tsvetkov, poselok Tomilino, ulitsa Gogolya, 30, kv. 74, Moskovskaya oblast; Alexandr M. Onischenko, Ljibertsy Oktyabrsky prospekt, 384/2, kv. 17, Moskovskaya oblast; Anatoly I. Kandala, Ljibertsy, Oktyabrsky prospekt, 380/zh, kv. 33, Moskovskaya oblast; Valery G. Khrapov, Ljubertsy, Oktyabrsky prospekt, 170/7, kv. 30, Moskovskaya oblast; Georgy M. Nunuparov, Ljubertsy, Oktyabrsky prospekt, 380e, kv. 45, Moskovskaya oblast; Vladimir M. Slavinsky, Ljubertsy, Komsomolsky prospekt, 9, kv. 92, Moskovskaya oblast; Isaak L. Geikhman, ulitsa Velyaminovskaya, 6, korpus 1, kv. 302, Moscow; Nikolai P. Omelchenko, Shkolny bulvar, 13, kv. 35, Donetsk; Boris A. Rafalovich, poselok Tomilino, ulitsa Gogolya, 13, kv. 9, Moskovskaya oblast; Viktor I. Silaev, ulitsa Krasnoflotskaya, 100b, kv. 101; Konstantin F. Zhdanov, ulitsa Artema, 58, kv. 9, both of Donetsk, all of U.S.S.R.

[21] Appl. No.: 265,807

[22] PCT Filed: Dec. 25, 1986

[86] PCT No.: PCT/SU86/00121

§ 371 Date: Jul. 25, 1988

§ 102(e) Date: Jul. 25, 1988

[87] PCT Pub. No.: WO88/05116

PCT Pub. Date: Jul. 14, 1988

[51] Int. Cl.[5] ..... G01T 5/00

[52] U.S. Cl. ..... 250/253; 250/265; 250/267; 250/374; 250/385.1

[58] Field of Search ..... 250/253, 265, 266, 267, 250/374, 385.1

[56] References Cited

U.S. PATENT DOCUMENTS

| | | | |
|---|---|---|---|
| 3,019,338 | 1/1962 | Monaghan et al. | 250/253 |
| 3,321,625 | 5/1967 | Wahl | 250/268 |
| 3,418,474 | 12/1968 | Spergel et al. | 250/385.1 |
| 3,546,456 | 12/1970 | Grice | 250/253 |
| 3,846,631 | 11/1974 | Kehler | 250/269 |
| 4,525,854 | 6/1985 | Molbert et al. | 378/89 |
| 4,701,868 | 10/1987 | Regimand | 364/558 |

FOREIGN PATENT DOCUMENTS

| | | | |
|---|---|---|---|
| 203800 | 12/1967 | U.S.S.R. . | |
| 1024857 | 6/1983 | U.S.S.R. | 250/253 |

OTHER PUBLICATIONS

"Regulyator s Izotopnym Datchikom Poroda–Ugol dlya Upravlenia Ochistnymi Kombainami po Gipsometrii Plasta", by Z. A. Chernyak et al., Ugol, No. 12, Dec. 1976 (Nedra, Moscow), pp. 38–39.

"Automatic Steering of Cutter–Loader in Wallstenton Mine", by D. Hartley, Mining Engineer, vol. 130, No. 124, 1971, pp. 221–236.

*Primary Examiner*—Constantine Hannaher

*Attorney, Agent, or Firm*—Fleit, Jacobson, Cohn, Price, Holman & Stern

[57] ABSTRACT

A method for monitoring a hidden coal-rock interface, comprising the steps of irradiating the medium (M) being monitored from a gamma-ray source (1) and registering by a detector (2) the intensity of backward scattered radiation at a distance (A) from the surface of the medium (M) and at a distance (B) from the radiation source (B). Two zones ($Z_1$ and $Z_2$) are formed at the detector (2) for reception of backward scattered radiation, differently spaced from the source (1), so that the intensity of backward scattered radiation received by the zone ($Z_1$) closer to the source (1) diminished with the distance (A) from the detector (2) to the medium (M), and grows when received by the zone ($Z_2$) far (Abstract continued on next page.)

from the source (1). The intensities of backward scattered radiation of both zones ($Z_1$ and $Z_2$) are summed up to obtain total intensity invariant with respect to variations of the distance (A) between the detector (2) and the medium (M). A transducer realizing the above method comprises a housing accomodating the gamma-ray source (1) and backward scattered radiation detector (2) shielded by a screen (3) provided with ports at different distances from the source (1). The area of the port farther from the source (1) is greater than that of the nearer port; the distance (B) from the gamma-ray source (1) to the detector (2) does not exceed a preset maximum distance ($A_2$) from the detector (2) to the medium (M) being monitored.

9 Claims, 4 Drawing Sheets

METHOD OF MONITORING HIDDEN COAL-ROCK INTERFACE AND TRANSDUCER REALIZING THIS METHOD

FIELD OF THE INVENTION

The present invention relates to devices for automatic steering of coal-winning machines according to seam hypsometry and, more particularly, it relates to a method of monotoring hidden coal-rock interface and to a transducer realizing this method and intended to minitor hidden coal-rock interface by registering the intensity of back scattered gamma-radiation.

The present invention can be emploted to utmost advantage for non-contact monitoring of coal-rock interface for automation of front-loading units, cutter-loaders of any size, units for chamber extraction, and other machines operated for full-seam extraction.

The invention can also be employed in geological exploration of bedrock wherever it occurs: on the surface, in mine workings, or in boreholes.

The invention can be further used for measuring the density of soil, rock, and various construction materials in situations of one-sided accessibility to areas being explored. It can be also embodied in mobile density meters for measuring the desity of rock along geological profiles, sections, and routes.

The invention can be also employed for monitoring the thickness of material in an environment of one-sided access to a medium being investigated, with a variable air gap between the transducer and medium, e.g. a layer of material carried by a running conveyer belt, or else moving rolled strip or sheet.

PRIOR ART

There is known a transducer of a hidden coal-rock interface developed in Great Britain (see D. Hartlet "Automatic steering of cutter-loader in Wallstenton Mine", Mining Engineer, 1971, Vol. 130, No. 124, P. 221) comprising a housing accomodating a gamma-ray source and a detector of back scattered gamma-radiation, spaced from the center of the source. The method of monitoring a hidden coal-rock interface embodied in this known transmitter includes irradiating the medium being monitored from the gamma-ray source, registering backward scattered gamma-radiation by the detector, and determining the hidden coal-rock interface from the intensity of backward scattered gamma-radiation thus detected. To ensure reliable performance of the device, the transmitter is urged against the roof of a mine working by a double-acting jack.

To provide favourable conditions for moving the transmitter along the roof, the transmitter is provided with tail portions at the sides of the source and of the detector. The total length of the transmitter with the tail portion is 120 cm.

The transmitter incorporates a cavity detector which disconnects the automatic control system of the cutter-loader when an air gap occurs between the transmitter and the medium being monitored, as the presence of an air gap results in the transmitter sending false signals causing malfunctioning of the entire cutter-loader control system.

Normal performance of the known transmitter is dependent on its reliable engagement with the rock body being monitored, which necessitates the employment of complicated hold-down and urging devices, as well as the incorporation of a cavity-detecting device.

Furthermore, the reliability of this contact-type transmitter is affected by its operation in continuous friction-type engagement which is difficult to maintain with adequate dependability from a moving machine. As it has been already mentioned, should an air gap occur between teh transmitter and the medium being monitored, the credibility of data sent out by the transmitter is impaired.

The transmitter is rather large and cannot be built inot the screw conveyor structure of the cutter-loader to reduce to zero the transport lag. On account of the considerable dimensions of the known transmitter, it is positioned at the seam top behind the screw conveyor, which causes a transport lag between the point of application of the control action (accounting for a varying relief of the seam top) and the point of the monitoring of this action. The transport lag impairs the effectiveness of both monitoring and control.

Attempts to operate the known transmitter for monitoring the bottom of a seam have so far been unsuccessful on account of its high susceptibility to variations of the air gap between the transmitter and the medium being monitored.

There is further known a tansmitter for monitoring a hidden coal-rock interface, based on density measurements (see U.S. Pat. No. 3,321,625), comprising a radiation source with Cesium$^{137}$accommodated in a collimator, and two detectors. The transmitter incorporates a spring device urging it against the surface being monitored and also serving as a borehole caliper. The bottom detector (a gas-discharge counter) is set close to the housing at a small spacing (17.8 cm) from the radiation source, while the top detector (a scintillation counter) is mounted inside the collimator at a 40.6 cm distance from the source. The bottom detector is connected to an intensity meter, and the top counter is connected through an amplitude analyzer to its own intensity meter. The two intensity meters are connected with a computation device determining the logarithm of the ratio of the signals coming from the detectors. To absorb soft (low-energy) gamma radiation of energy below 50 keV, a silver or cadmium screen is interposed between the scatterer and the remote detector, the latter being intended for measuring density values with eventual compensation for the influence of clay crust present in the borehole intermediate the transmitter and the surface being monitored; however, the output signal of the detector is highly susceptible to a varying air gap between the transmitter and the medium being monitored. The last-mentioned fact necessitates highly reliable urging of the transmitter against the medium being monitored, so that despite the incorporation of sophisticated urging devices and cavity monitors, the reliability of the performance of the transmitter is impaired. Relatively great dimensions of the transmitter would not allow to accommodate it directly within the cutting tool along the cutting line of its teeth, which, as it has been already explained hereinabove in connection with the coal-rock interface monitor, impairs the effectivemenss of the monitoring and control operation.

DISCLOSURE OF THE INVENTION

It is an object of the present invention to provide a simple method of non-contact monitoring of a hidden coal-rock interface, and to embody this method in a compact transmitter-monitor of a coal-rock interface, invariant with respect to air gap fluctuations, which should enhance the performance reliability of the transmitter in operation both at the top and bottom of a seam, thus providing for efficient monitoring and control.

With this object in view, the essence of the invention resides in a method of monitoring a hidden coal-rock interface, including irradiating a medium being monitored from a gamma-ray source, registering backward scattered gamma radiation by a detector, and determining the hidden caol-rock interface from the intensity of backward scattered radiation, in which method, in accordance with the invention, the registration of backward scattered gamma radiation is performed at a distance from the surface of the medium being monitored and at a distance from the gamma-ray source, not exceeding a preset value of maximum spacing of the detector from the medium being monitored, there being formed at the detector two zones of reception of backward scattered radiation, differently spaced from the radiation source, so that the intensity of backward scattered raditaion received by the zone closer to the source diminishes with an increasing spacing of the detector from the medium being monitored, while the intensity of backward scattered radiation received by the zone more remote from the source grows, the intensities of backward scattered radiation received at the two zones being summed up to obtain the summary intensity of backward scattered radiation invariant with respect to a varying spacing of the detector from the medium being monitored.

The disclosed method provides for conducting non-contact monitoring of a hidden coal-rock interface, while ensuring invariance of received backward scattered gamma-radiation with respect to a varying spacing of the detector from the medium being monitored, so that the reliability and efficiency of the monitoring operation are enhanced.

It is expedient that invariance of the summary intensity of backward scattered radiation with respect to a varying spacing of the detector from the medium being monitored within a preset maximum value of this spacing should be provided for by varying the surface area of the reception zones fo the detector.

A variation of the surface area of the reception or responsive zones is the simplest way of realizing the diminshing and growing character of the intensities of received backward scattered gamma radiation in response to a varying spacing of the detector from the medium being monitored.

It is also possible to additionally ensure invariance of the summary intensity of received backward scattered gamma radiation with respect to a varying spacing of the detector from the medium being monitored by displacing the radiation source and/or the detector in a vertical plane.

Such displacement of the source and/or detector permits a high accuracy in avoiding the influence of the spacing of the detector from the medium being monitored within a preset range of its variation.

It is alternatively possible to additionally ensure invariance of the total intensity of received backward scattered radiation with respect to a varying spacing of the detector from the medium being monitored by varying the angle of incidence of gamma-rays from the source on the medium being monitored.

Such variation of the incidence angle of gamma-rays allows to extend the range of no response of the total intensity of received backward scattered gamma radiation to a varying spacing of the detector from the medium being monitored when this radiation is measured at a minimum spacing from the gamma-ray source.

It is expedient tht a transmitter of a hidden coal-rock interface, comprising a housing accommodating a gamma-ray source and a detector of backward scattered gamma radiation spaced from the source and enclosed in a screen attenuating backward scattered radiation should have, in accordance with the invention, ports made in the screen at different distances from the gamma-ray source, the area of the port more remote from the source being greater than the area of the port less remote from the source, and the spacing of the source from the detector not exceeding a preset value of the maximum spacing of the detector from a medium being monitored.

This design of a transmitter provide for substantially reducing its dimensions, while at the same time ensuring invariance of its output signal with respect to a varying air gap between the transmitter and the medium being monitored, thus enhancing the reliability of the monitoring operation.

It is expedient that the ports should have their respective areas ensuring that the sum of the intensities of bakcward scattered radiation received by the detector through the respective ports is substantially permanent within a preset range of variation of the air gap, to enhance the accuracy of the monitoring of a coal-rock interface.

It is reasonable to select the material and thickness of the screen from a condition:

$$2 \leqq \exp(\mu\rho d) \leqq 300,$$

where $\mu$ is the mass coefficient of attenuation of gamma radiation by the screen, $cm^2/g$;

$\rho$ is the density of the material of the screen, $g/cm^3$;

d is the thickness of the screen, cm.

the above condition offers the simplest approach to the selection of the required material and thickness of the radiation-filtering screen, providing for a maximum attainable value of the intensity of backward scattered gamma radiation, invariant with respect to a varying air gap between the transducer and the medium being monitored.

It is expedient that one end of the housing should be cut at an angle of 25° to 50° to the base of the housing, the housing having an opening made therein normally to the cutting plane, accommodating the gamma-ray source, the detector including a holder with a plurality of gas-discharge counters arranged normally to the base of the housing and connected in parallel with one another.

This design of a transmitter, while retaining its compact size, provides for sharply extending its range of no response to a varying air gap between the transducer and the medium being monitored.

It can be expedient to mount the radiation source and/or detector in the housing adjustably in a vertical plane.

With the source and/or detector thus mounted, the accuracy of ensuring invariance of the output signal of the transducer with respect to a varying spacing of the transducer from the medium being monitored within a required range of this variation is enhanced, while the compact size of the transmitter is retained.

BRIEF DESCRIPTION OF THE DRAWINGS

Other objects and advantages of the present invention will be better understood from the following description of its embodiment, with reference being made to the accompanying drawings, wherein.

BEST MODE FOR CARRYING OUT THE INVENTION

Figure 1:
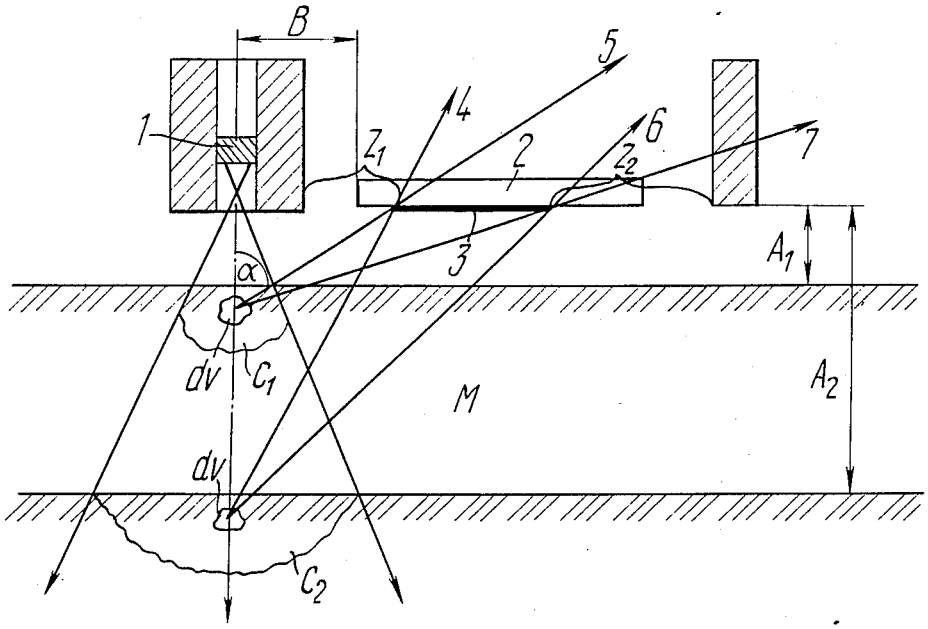
FIG. 1 schematically illustrates the essence of a method of monitoring a hidden coal-rock interface in accordance with the invention.
Figure 2:
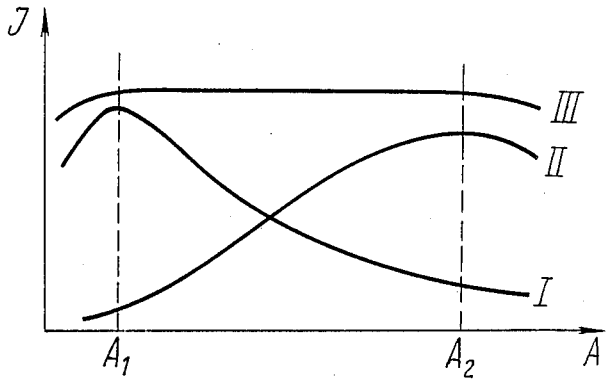
FIG. 2 is a diagram of intensity of back scattered gamma radiation against the spacing of the detector from the medium being monitored.

The essence of the present invention is illustrated by the schematic drawing of FIG. 1 and the diagram of FIG. 2.

In the description hereinbelow, like parts will be referred to by like numerals and symbols.

A medium being monitored is irradiated from a gamma-ray source 1, and backward scattered radiation is registered by a detector 2. In a general case being presently described, the medium M bein monitored is a layer of coal of certain thickness overlying rock in the form of a semi-infinite layer.

With the thickness of the coal layer overlying the rock increasing, the intensity of backward scattered gamma radiation grows, and with this thickness decreasing, the intensity diminishes. Thus, the value of intensity is considered representative of the thickness of coal overlying the rock, in which way the hidden coal-rock interface is located. The intensity of backward scattered gamma radiation also varies with a varying spacing $A_1$ of the detector 2 from the surface of the medium M being monitored, which impairs the credibility of the monitoring of a coal-rock interface.

To ensure that the intensity of backward scattered gamma radiation is unaffected by or invariant with respect to a varying spacing $A_1$, the registering of backward scattered radiation is carried out at a spacing from the surface of the medium M being monitored and at a distance B from the source 1 of gamma-rays to the detector 2, the value of this distance B not exceeding the maximum predetermined spacing $A_2$ of the detector 2 from the medium M being monitored. There are formed at the detector 2, e.g. with the aid of a screen 3 of a predetermined thickness, two zones of reception differently spaced from the source 1: respectively, an adjacent zone $Z_1$ and a remote zone $Z_2$, the intensities of backward scattered radiation received in the two zones $Z_1$ and $Z_2$ being summed up to obtain the summary intensity invariant with respect to the spacing of the detector from the medium being monitored, this value being used to locate the hidden interface between coal and rock. With the spacing of the transmitter from the medium M being monitored varying from $A_1$ to $A_2$, the intensity $I_{Z1}$ of backward scattered gamma radiation registered by the detector 2 as received at the zone $Z_1$ closer to the source 1 would also vary, the character of its variation being defined by the following factors.

First, the value of intensity $I_{Z1}$ would grow owing to the growing area of two-way source/detector visibility in the medium being monitored (this area $C_2$ of two-way visibility being greater than the area $C_1$).

Second, the value of intensity $I_{Z1}$ would diminish due to the reduction of the working volume of the detector 2 registering backward scattered gamma radiation received at the close area $Z_1$.

It can be clearly seen in FIG. 1 that with the spacing from the monitored medium M equalling $A_2$ and with radiation being scattered by an elementary volume "dv", the working volume of the detector 2 limited by the ray 4 is less than the working volume of the detector 2 limited by the ray 5 when the spacing from the monitored medium M equals $A_1$. Employing the screen 3, the reception zone $Z_1$ is so formed that the second-mentioned factor should dominate (over the first-mentioned one), and the intensity $I_{Z1}$ should diminsh with an increasing spacing from $A_1$ to $A_2$ (curve I in FIG. 2).

Plotted in FIG. 2 are curves illustrating the dependence of the intensity of backward scattered gamma radiation on the spacing of the detector from the medium being monitored, the Y-axis showing the intensity I, pulses per second, and X-axis representing the spacing A, mm. Curve I in the diagram is the dependence $I_{Z1}=f(A)$, i.e. variation of the intensity of backward scattered gamma radiation received by the zone $Z_1$ as a function of the spacing from the medium being monitored.

Curve II in the same diagram is the dependence $I_{Z2}=f(A)$, i.e. variation of the intensity of backward scattered gamma radiation received by the zone $Z_2$ as a function of the spacing from the medium being monitored.

Curve III represents a function $(I_{Z1}+I_{Z2})=f(A)$, i.e. variation of the summary intensity of backward scattered gamma radiation received simultaneously by both zones $Z_1$ and $Z_2$ as a dunction of a varying spacing from the medium being monitored.

Factors similar to those described above influence the intensity $I_{Z2}$ of backward scattered gamma radiation received by the zone $Z_2$ remote from the source 1, which is formed by correspondingly selecting its area. However, with the spacing $A_1$ growing toward the predetermined maximum value $A_2$ of the spacing of the detector 2 from the medium M being monitored, the value of intensity $I_{Z2}$ would presistently grown (curve II in FIG. 2) owing to the increasing area of two-way source/detector visibility at the monitored medium M, and to the growing working volume of the detector 2 responding to backward scattered gamma radiation. The working volume of the detector 2 (FIG. 1) limited by the ray 6 is obviously greater than the working volume limited by the ray 7.

Thus, as it can be seen in FIG. 2, the summing up of the decresing intensity $I_{Z1}$ (curve I) and growing intensity $I_{Z2}$ (curve II) yields the summary intensity $I_{Z1}+I_{Z2}$ (curve III) of backward scattered gamma radiation received at the two zones, which is invariant with respect to the spacing of the detector 2 from the monitored medium M varying from $A_1$ to $A_2$.

Invariance of the summary intensity of backward scattered gamma radiation with respect to a varying spacing of the detector 2 from the monitored medium M can be also attained by displacing either the gamma-ray source 1 or the detector 2, or both, in a vertical plane.

Depending on the extent of the abovementioned displacement, the inversion point of the function $I_{Z1}=f(A)$ (curve I in FIG. 2) and the inversion point of the function $I_{Z2}=f(A)$ are either brought closer to each other or moved apart, so as to ensure invariance of the summary intensity $(I_{Z1}+I_{Z2})$ (curve III) with respect to a varying spacing from $A_1$ to $A_2$ of the detector 2 from the monitored medium M.

In the embodiment schematically illustrated in FIG. 1 the angle of incidence of gamma rays from the source 1 on the monitored medium M is 90° ($\alpha=90°$). According to the disclosed method, invariance of the summary intensity of backward scattered gamma radiation with respect to a varying spacing of the detector 2 from the monitored medium M can be also attained by varying the angle of incidence of gamma rays from the source 1 on the medium M being monitored. Thus, by decreasing the angle of incidence ($\alpha<90°$), the inversion point of the function $I_{Z2}=f(A)$ (curve II in FIG. 2) can be moved into the range of spacings $A>A_2$, which expands the range of invariance of the summary intensity $(I_{Z1}+I_{Z2})$ with respect to a varying distance or spacing of the detector 2 from the medium M being monitored.

The disclosed method provides for non-contact monitoring of a coal-rock interface at the minimum spacing B of the source 1 from the detector 2 under conditions of a varying spacing of the detector 2 from the medium M being monitored, while ensuring invariance of the registered intensity of backward scattered gamma radiation with respect to a variation of the last-mentioned spacing within an adequately broad range from $A_1$ to $A_2$, or even broader.

Figure 3:
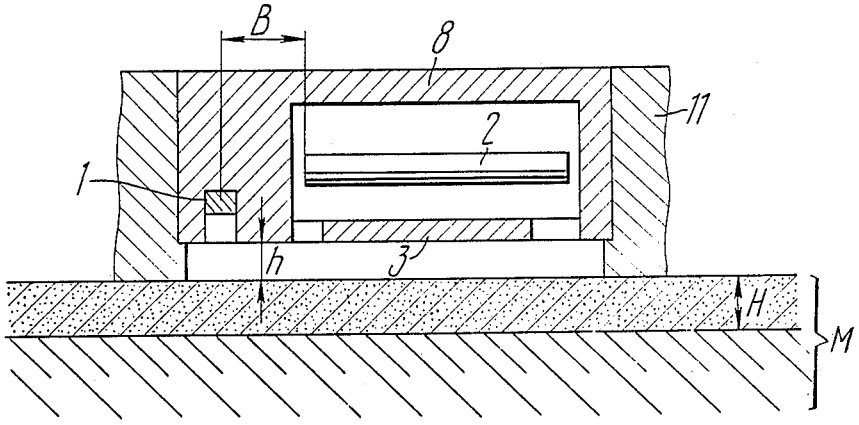
FIG. 3 schematically illustrates a longitudinally sectional view of a transmitter of a hidden coal-rock interface embodying the invention, in its first version.
Figure 4:
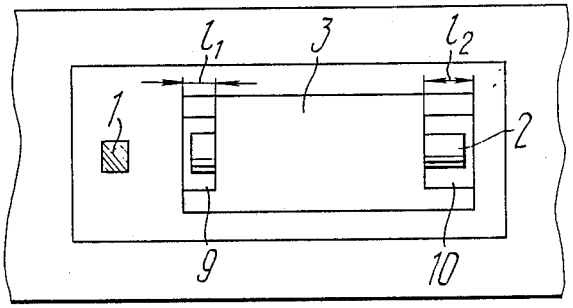
FIG. 4 shows the transmitter of FIG. 3, viewed from the side of the medium being monitored.

A method according to the invention can be performed by a transducer for monitoring a hidden coal-rock interface schematically illustrated in FIGS 3 and 4.

The transducer comprises a housing 8 having mounted therein a gamma-ray source 1 set at a spacing B from a detector 2 enclosed in a screen 3. The gamma-ray source 1 and detector 2 are both mounted for adjustment in a vertical plane. The screen 3 has ports made therethrough, differently spaced from the gamma-ray source 1: a port 9 of an area $S_1$ closer to the source 1 and a port 10 of an area $S_2$ remote from the source 1, the area $S_2$ of the port 10 more remote from the source 1 being greater than the area $S_1$ of the port 9 closer to the source 1. The spacing B of the gamma-ray source 1 and detector 2 does not exceed a predetermined maximum value of the spacing of the detector 2 from the medium M being monitored. Under real operating conditions, of practical importance is the value of the spacing of the transmitter from the monitored medium, which will be hereinafter referred to as an air gap "h"between the transmitter and the monitored medium M.

The monitored medium M represented in the embodiment being described by a band of coal of a thickness H overlying the parent rock will be referred to hereinafter as the monitored coal-rock medium.

The shape of the ports 9 and 10 shown in FIG. 4 is square for the utmost simplicity of making them; however, the ports 9 and 10 may have different shapes, e.g. oval or trapezoidal, provided that their areas are not equal, i.e. $S_2>S_1$.

The housing 8 of the transducer being described additionally accommodates componenets commonly incorporated in transducers of this general type, such as a converter for power supply of the detector 2 and a pulsed amplifier for transmitting pulsed signals from the transmitter via a cable to secondary measuring apparatus (the converter and amplifier not shown in the appended drawings for clarity sake).

The housing 8 of the transmitter further accommodates a device (not shown, either) for actuating the source 1 between operative and inoperative positions, to ensure safe handling of the transmitter in compliance with applicable health standards.

The transducer being described is built into an appropriate assembly 11 of a mining machine at a spacing "h" from the medium being monitored, the value of "h" being selected to suit the operation of the machine to be automated (e.g. a cutter-loader or a winning unit etc.).

The transducer operates, as follows.

Gamma rays from the source 1 fall upon the monitored coal-rock medium M to be scattered and reflected thereby. Backward scattered gamma radiation is registered by the detector 2. The rays directed straight from the source 1 toward the detector 2 are practically completely absorbed by the thickness of the materila of the housing 8 of the transmitter intermediate the source 1 and detector 2.

The intensity I of backward scattered gamma radiation registered by the detector 2 serves as a measure of the thickness H of the coal band, growing as this thickness grows. Thus, the value of intensity I is taken to be representative of the thickness H of the coal band overlying the parent rock, in which way a hidden coal-rock interface is actually located. The detector 2 registers backward scattered gamma radiation passing through the screen 3, port 9 closer to the source 1 and port 10 more remote from this source 1. The material and thickness of the screen 3 are selected to satisfy the condition:

$$2 \leqq \exp(\mu\rho d) \leqq 300,$$

where $\mu$ is the mass coefficient of attenutation of gamma radiation by the screen, $cm^2/g$;

$\rho$ is the density of the material of the screen, $g/cm^3$;

d is the thickness of the screen, cm.

With the energy of gamma radiation E=60 keV and the screen 3 made of iron, the above condition is satisfied by a thickness "d" of the screen from 0.1 to 0.6 cm. This range of thicknesses of the screen 3 provides for obtaining the maximum intensity of backward scattered gamma radiation, registered by the detector 2, which is invariant with respect to fluctuations of the spacing "h" of the detector 2 from the monitored medium M. With the thickness of the screen 3 below 0.1 cm the role of the screen 3 as a means of separating the reception zones at the detector 2 is substantially impaired. On the other hand, with the thickness of the screen 3 in excess of 0.6 cm the value of the intensity of backward scattered gamma radiation registered by the detector 2 sharply drops. The areas of the square ports 9 and 10 in the screen 3 are controlled by varying the length $l_1$ of the port 9 and the length $l_2$ of the port 10. The areas of the ports 9 and 10 in the screen 3 are selected to provide for the sum of the intensities of backward scattered gamma radiation received by detector 2 through the respective ports being substantially permanent within the predetermined range of variation of the air gap "h" between the transmitter and the monitored coal-rock medium. This permanence of the summary intensity of bakcward scattered gamma radiation received by the detector 2 through the respective ports is also ensured by vertically adjusting either the source 1 or the detector 2, or both.

To provide for adequate performance reliability of the transmitter and to protect the latter positively from mechanical damage, the transducer is mounted on a coal-winning machine with an air gap "h" left between it and the medium being monitored. With the transducer mounted in load-supporting structures (bases of power support units, chutes of a flight conveyer, loading boards and the like), the value of the air gap "h" is set to be from 5 to 10 mm, and invariance of the summary intensity of backward radiation received by the detector 2 through the ports 9 and 10 is provided for within a range of variation of this gap "h" between 5 mm and 60 mm. With the transducer incorporated in the cutting member of a cutter-loader, below the level of the cutting bit holders, the value of the gap "h" is set to about 80 mm, depending on the radial outreach of the cutting bits employed, and invariance of the summary intensity of backward scattered gamma radiation received by the detector 2 through the ports 9 and 10 is provided for within a range of variation of this gap "h" from 30 to 120 mm.

Figure 5:
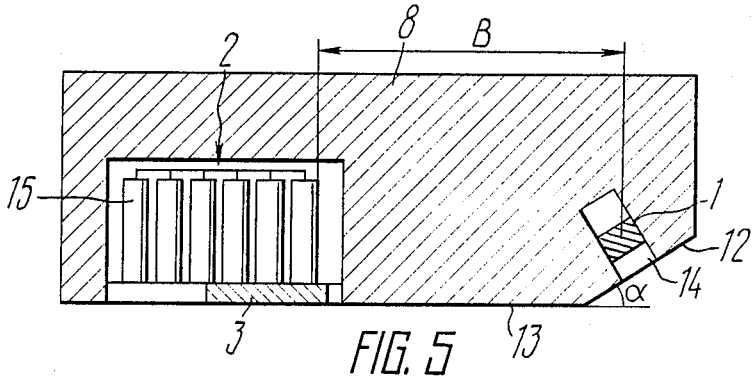
FIG. 5 schematically illustrates a longitudinally sectional view of a transmitter of a hidden coal-rock interface embodying the invention, in its second version.
Figure 6:
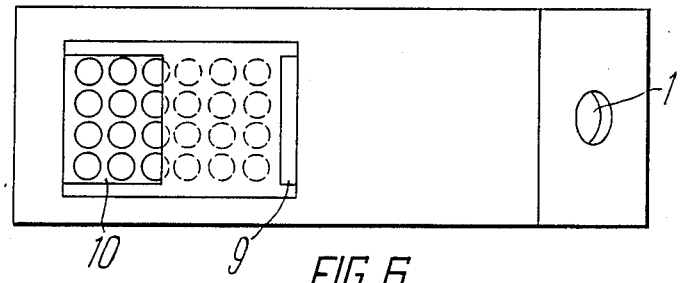
FIG. 6 shows the transmitter of FIG. 5, viewed from the side of the medium being monitored.

Schematically illustrated in FIGS. 5 and 6 is a modified version of the transducer. It comprises a housing 8 having mounted therein a gamma-ray source 1 set at a spacing B from a detector 2 enclosed in a screen 3. The gamma-ray source 1 and detector 2 are mounted for vertical adjustment. The screen 3 has ports made therethrough, differently spaced from the gamma-ray source 1: a port 9 of an area $S_1$ closer to the source 1 and a port 10 of an area $S_2$ more remote from the source 1, the area $S_2$ of the port 10 remote from the gamma-ray source 1 being greater than the area $S_1$ of the port 9 closer to the source 1. One end face of the housing 8 is cut 12 at an angle $\alpha=25°...50°$ to the base 13 of the housing 8, with an opening 14 made in the housing 8 normally to the cutting plane 12 to accommodate the gamma-ray source 1.

With the cut 12 thus made and the gamma-ray source 1 thus arranged, gamma rays from the source 1 are incident on the monitored medium at an acute angle.

The detector 2 in this embodiment of the tranducer is a holder of gas-discharge counters 15 connected in parallel and mounted normally to the base 13 of the housing 8.

the operation of the tranducer with the cut 12 and spatial detector 2 is similar to that of the transducer illustrated in FIG. 3 and described hereinabove. It should be pointed out, however, that the incidence of gamma rays at an angle $\alpha$ allows to displace the inversion point of the function $I_{Z2}=f(a)$ (curve II in FIG. 2) to a range of spacings $A>A_2$, thus expanding the range of invariance of the summary intensity (curve III in FIG. 2) with respect to a varying spacing of the detector 2 from the monitored medium M. The expansion of the last-mentioned range is further supported by the increased volume of the detector 2 in the form of a holder of gas-discharge counters arranged perpendicularly to the base of the housing.

The parallel electric connection of the counters steps up the summary registered intensity of backward scattered gamma radiation.

For practical use, there have been developed prototypes of radio-isotope coal-rock interface transducers of three types:

(1) for mounting on conveyer-screw working members (of diameters upwards of 0.7 m) of coal cutter-loaders, offering invariance with respect to the air gap between the transducer and the monitored medium varying within a 10 mm to 120 mm range; the overall dimensions of a transducer being 110×70×65 mm;

(2) for building into loading boards of cutter-loaders, offering invariance with respect to the air gap between the tranducer and the monitored medium varying within a 5 mm to 70 mm range; the transducer overall dimensions being 130×130×55mm;

(3) for incorporation into the supporting surfaces of the working-face equipment (bases of power support units, conveyers chutes, support skids, etc.), offering invariance with respect to the air gap between transducer and the monitored medium varying within a 5 mm to 70 mm range; the transducer overall dimension being 280×120×70 mm.

The prototype transucers employ a source of low-energy gamma radiation of radionuclide of Americium$^{241}$ (radiation energy 60 keV, half-life period over 400 years, activity 200 mCi), and miniature gas-discharge halogen counters.

Figure 7:
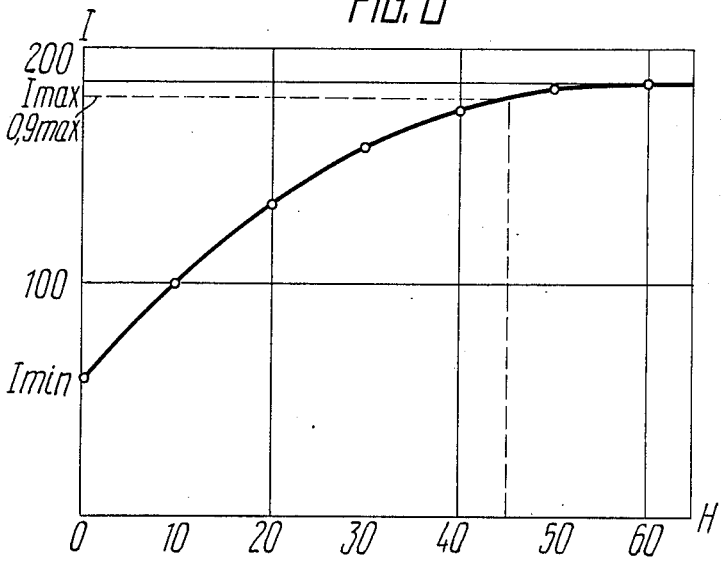
FIG. 7 is a diagram of the intensity of back scattered gamma radiation against the thickness of a coal band overlying the rock.

FIG. 7 presents a plot of intensity of backward scattered gamma radiation as a function of the thickness of a coal band overlying parent rock for the three above-described prototypes of compact transducers, the Y-axis being intensity I, pulses per second, and the X-axis being thickness of the coal band, mm.

The value $I_{min}$ corresponds to the intensity of backward scattered gamma radiation coming from rock (H=O), and the value $I_{max}$ corresponds to the intensity of gamma radiation scattered backward by a 60-mm thick band of coal overlying the rock.

The plot proves that the differentiating (discriminating) capacity $\delta=I_{max}:I_{min}$ of the transmitter is at least 2.5:1, and the depth factor determined at a 0.9 $I_{max}$ level is 45 mm, which is quite sufficient for monitoring a coal-rock interface under conditions of full-seam extraction.

Figure 8:
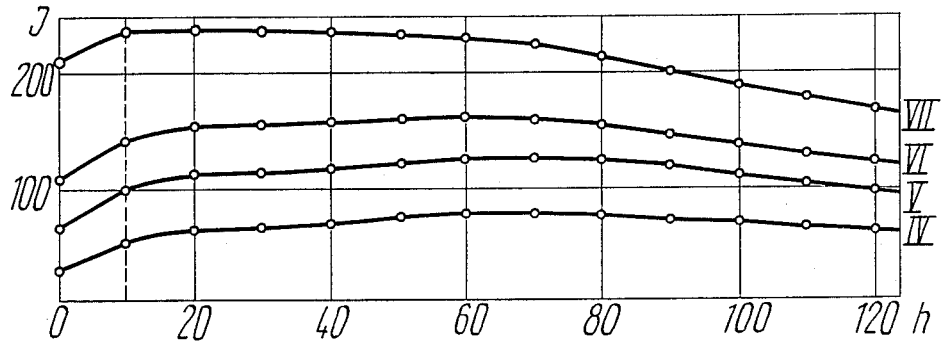
FIG. 8 shows a diagram of the intensity of back scattered radiation against the air gap between the transducer and the medium being monitored, the transducer being placed ont he conveyer-screw working members.
Figure 9:
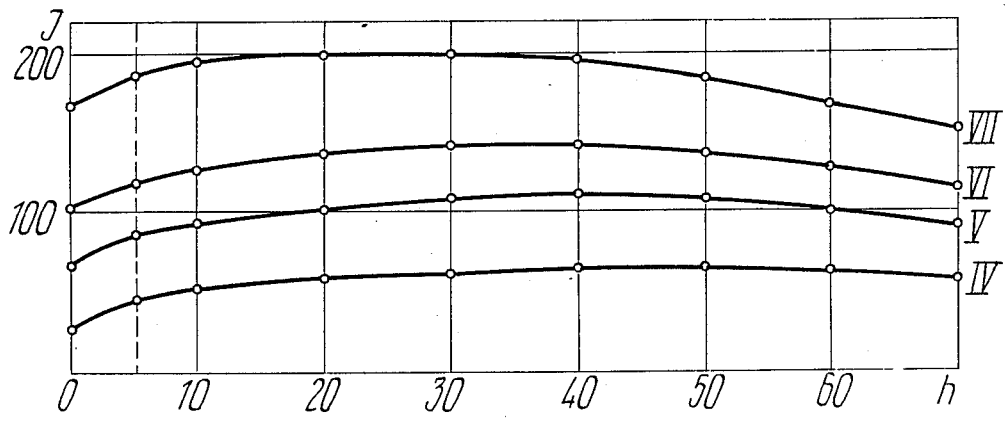
FIG. 9 is a diagram of the intensity of back scattered gamma radiation against the air gap between the transducer and the medium being monitored, with the transducer built into the supporting surfaces of the working-face equipment (loading boards, bases of power support units, conveyer chutes, support skids, etc.).

FIG. 8 presents a plot of intensity of registered back scattered gamma radiation as a function of the the air gap between the transducer and monitored medium for a transmitter mounted on the conveyer-screw working members of coal cutter-loaders; and FIG. 9 presents a similar plot for a transmitter mounted in the loading board of a cutter-loader and other supporting surfaces of working-face equipment.

The Y-axis shows intensity, pulses per second, and the X-axis is the air gap "h", mm. Curve IV of the plot is a function I=f(h) with gamma radiation scattered by parent rock (H=O); curve V is the same, with a coal band H=10mm overlying the rock; curve VI is the same with a coal band H=20 mm overlying the rock; curve VII is the same with a coal band H=50 mm overlying the rock. The curves show that the intensity of backward scattered gamma radiation varies but slightly and practically is permanent throughout the range of variation of the air gap between 10 mm and 120 mm (FIG. 8) and between 5 mm and 70 mm (FIG. 9).

The insensibility to fluctuations of the air gap between the transducer and the medium being monitored in combination with the compact size of a transmitter provides for noncontact monitoring of a coal-rock interface in close proximity to the generatrix of the cutting line and the breast, which enhances the monitoring reliability and the efficiency of the entire system controlling the work-performing members in relation to the coal-rock interface.

INDUSTRIAL APPLICABILITY

The disclosed method of monitoring a hidden coal-rock interface and a transducer performing this method can be advantageously employed for non-contact monitoring of a coal-rock interface as part of automatic control of the work-performing cutting members of screw-type coal cutter-loaders, of front-loading units, chamber excavation machines and other equipment operated for full-seam extraction.

The economic effect of the implementation of the invention arises from reduced ash content of produced coal, from prevention of destruction of the rock surrounding a coal seam, and from stepped-up yield of coal owing to the eliminated necessity of maintaining a relatively thick safety band of coal over the parent rock.

We calim:

1. A method of monitoring a hidden coal-rock interface, comprising the steps of irradiating the medium being monitored from a gamma-ray source, registering backward scattered radiation by a detector, and determining the hidden coal-rock interface from the intensity of the backward scattered radiation, characterized in that backward scattered radiation is registered at a distance from the surface of the medium being monitored and at a distacne from the gamma-ray source, which does not exceed a preset maximum distance from the detector to the medium, while two zones of reception of backward scattered radiation are formed at the detector, differently spaced from the radiation source, so that the intensity of the backward scattered radiation received by the zone closest to the radiation source diminishes with the distance to the detector to the medium, whereas the intensity of backward scattered radiation received by the zone far from the radiation source increases, in which case the intensities of backward scattered radiation received by both zones are summed up to obtain the total intensity of backward scattered radiation invariant with respect to the varying distacne from the detector to the medium.

2. A method as claimed in claim 1, characterized in that the invariance of the total intensity of backward scattered radiation with respect to the varying distance between the detector to the medium being monitored, within a preset maximum distance is provided for by pre-changing the surface area of detector reception zones.

3. A method as claimed in claim 2, characterized in that the invariance of the total intensity of received backward scattered radiation with respect to the varying distance between the detector and medium being monitored is additionally provided for by prechanging the angle of incidence of gamma rays from the source onto the medium being monitored.

4. A method as claimed in claim 1, characterized in that the invariance of the total intensity of backward scattered radiation with respect to the varying distance between the detector and medium being monitored is additionally provided for by pre-displacing the radiation source and/or detector in the vertical plane.

5. A tranducer for monitoring the hidden coal-rock interface, realizing the method of claim 1, comprising a housing accommodating a gamma ray source and a detector of backward scattered radiation, whiuch is placed at a distance from the source and shielded by a screen attenuating backward scattered gamma radiation, characterized in that the screen is provided with ports different distnces from the source of gamma radiation, the area of the far port being greater than that of the port closer to the source, while the distance from the gamma radiation source to the detector does not exceed the preset maximum distance from the detector to the medium (M).

6. A transducer as claimed in claim 5, characterized in that the ports have sufficient area ensuring that the sum of intensities of backward scattered radiation received by the detector through each of the ports is substantially constant within the limits of a present range of the distance from the detector to the medium.

7. A transducer as claimed in claim 6, characterized in that the material and thickness of the screen are selected from the condition:

$$, 2 \leqq \exp(\mu\rho d) \leqq \neq 300,$$

where:

$\mu$ is the mass coefficient of attentuation of gamma radiation by the screen, $cm^2/g$;

$\rho$ is the density of the screen material, $g/cm^3$;

d is the thickness of the screen, cm.

8. A transducer as claimed in claim 5, characterized in that one end of the housing has a cut at an angle of 25°–50° to the base of the housing, and an opening is provided in the housing perpendicular to the plane of the cut, this opening accommodating the gamma ray source while the detector is made as a holder with a plurality of gas-discharge counters arranged normally to the base of the housing and connected in parallel with one another.

9. A transducer as claimed in claim 5, characterized in that the gamma ray source and/or the detector are mounted in the housing adjustably in the vertical plane.

* * * * *